United States Patent [19]

Bartlett

[11] Patent Number: 5,052,110

[45] Date of Patent: Oct. 1, 1991

[54] CAN OPENER

[75] Inventor: Laurence Bartlett, Colchester, Vt.

[73] Assignee: Edlund Company, Inc., Burlington, Vt.

[21] Appl. No.: 557,179

[22] Filed: Jul. 23, 1990

[51] Int. Cl.[5] ..... B67B 7/32; B67B 7/14; B67B 7/30; B67B 7/00

[52] U.S. Cl. ..... 30/434; 30/433; 30/435; 30/448

[58] Field of Search ..... 30/434, 435, 436, 442, 30/447, 448, 433

[56] References Cited

U.S. PATENT DOCUMENTS

| | | | |
|---|---|---|---|
| 528,371 | 10/1894 | Keller | 30/433 |
| 1,974,671 | 9/1934 | Egan | 30/433 |
| 4,651,962 | 3/1987 | Helgesson | 30/435 |
| 4,652,243 | 3/1987 | Crosslen | 30/448 |
| 4,689,886 | 9/1987 | Bernazzani et al. | 30/433 |

FOREIGN PATENT DOCUMENTS

| | | | |
|---|---|---|---|
| 686574 | 8/1951 | France | 30/434 |
| 15696 | of 1907 | United Kingdom | 30/434 |

*Primary Examiner*—Douglas D. Watts
*Assistant Examiner*—Paul M. Heyrana, Sr.
*Attorney, Agent, or Firm*—Collard, Roe & Galgano

[57] ABSTRACT

The present invention relates to a can opener device of the type which rotates the can in contact with a cutting blade subassembly that cuts the top of the can. The subassembly can be readily removed from the device for ease of cleaning and for readily reversing or replacing the cutting blade.

10 Claims, 5 Drawing Sheets

CAN OPENER

BACKGROUND OF THE INVENTION

1. Field of the Invention

The present invention relates to a can opener device of the type which rotates the can in contact with a cutting blade subassembly that cuts the top of the can. The subassembly can be readily removed from the device for ease of cleaning and for readily reversing or replacing the cutting blade.

2. The Prior Art

The Edlund U.S. Pat. No. 1,537,110, discloses a can opening device having means for engaging with the peripheral wall of a can of any one of a considerable range of sizes to cause rotation of the can in engagement with a cutting blade, adapted on rotation of the can in engagement therewith to roll the edge provided by the cutting of the blade in the can so that the edge of the opening defined by the cut will be continuously smooth. Means also is provided in the device for adjusting the position of the cutting blade with respect to the marginal edge of the can which is to be opened through the use of the device, so that the cutting blade will pierce the can top at a point somewhat removed from the marginal edge of the can top. Then the blade will be moved in cutting engagement with the can top nearly to the marginal edge of the can top and practically the entire top will be severed from the can when the latter has been completely rotated in engagement with the cutting blade.

A disadvantage of this can opening device is that the component parts are fastened together in such a manner that it is very difficult to disassemble the device for cleaning purposes or to repair or to replace a worn out part.

SUMMARY OF THE INVENTION

It is an object of the present invention to provide a can opener device that can readily be completely disassembled for cleaning purposes.

It is another object of the present invention to provide a can opener device that can readily be completely disassembled for repair or replacement of a worn out part.

The above objects are accomplished in accordance with the present invention by providing a cutting blade bell crank subassembly for use in a can opening device comprising a T-shaped bell crank lever having a horizontal arm connected to a vertical arm. The horizontal arm has a cut out reverse C-shaped end comprising two spaced apart elbows. The horizontal arm has a central portion adjacent to the cut out with the vertical arm attached to the horizontal arm at the central portion; and the horizontal arm has a third portion with a horizontal arm passageway therethrough. The vertical arm of the bell crank lever has an outside surface and an inside surface. The inside surface has a bushing adjacent to the horizontal arm lower surface. A vertical arm passageway connects the outside surface to the inside surface and is parallel to the bushing. A knife cutting blade has a pointed end for cutting open the top of a can to be opened, and has an opposite end with a cut out portion that fits around the bushing when the blade is adjacent to the inside surface of the vertical arm of the bell crank lever. A central screw threaded opening lines up with the bell crank vertical arm passageway. An adjustable fastener is placed adjacent to the outside surface of the vertical arm of the bell crank lever and extends through the vertical arm passageway and screws into the central screw threaded opening of the knife blade that lines up with the vertical arm passageway.

The above objects are furthermore accomplished in accordance with the present invention by providing a can opening device comprising a vertically adjustable post having a first end and a second end. A housing is located at the first end of the post, with the housing having a top end and a bottom end. The housing has a first opening at the bottom end and a second opening at the top end. A vertical shaft has a top end and a bottom end rotatably secured at the bottom end of the shaft within the housing at the bottom end of the housing. A handle is pivotally attached at a first end to the top end of the vertical shaft for causing the rotational movement of the vertical shaft by rotation of the handle. The handle has a cam at the first end of the handle for causing the vertical movement of the spool downwardly when the handle is pivoted vertically upwardly. The cam of the handle causes the vertical movement of the spool upwardly when the handle is pivoted vertically downwardly. A rotor within the housing is secured to the vertical shaft above the bottom end of the vertical shaft, with the rotor protruding through the first opening at the bottom end of the housing. The rotor has teeth on the periphery thereof for engaging and for rotating the can to be opened. An I-shaped spool on the vertical shaft is adjacent to the top end of the vertical shaft just below the handle. A spool comprising a upper horizontal arm and a lower horizontal arm has a vertical arm connecting the upper and lower horizontal arm a spaced distance apart. The vertical shaft passing through the hollow central portion of the spool. A T-shaped bell crank lever has a horizontal arm connected to a vertical arm. The horizontal arm has a cut out reverse C-shaped end comprising two spaced apart elbows. The horizontal arm has a central portion adjacent to the cut out end with the vertical arm attached to the horizontal arm at the central portion. The horizontal arm has a third portion with a horizontal arm passageway therethrough. The spaced apart elbows ar positioned within the I-shaped spool. The vertical arm of the bell crank lever has an outside surface and an inside surface, and the inside surface has a bushing adjacent to the horizontal arm lever surface. A vertical arm passageway connects the outside surface to the inside surface and is parallel to the bushing. A knife cutting blade has a pointed end for piercing and an angled edge for cutting open the top of a can to be opened, an opposite end with a cut out portion fits around the bushing when the blade is adjacent to the inside surface of the vertical arm of the bell crank lever. A central screw threaded opening lines up with the bell crank vertical arm passageway. An adjustable fastener is placed adjacent to the outside surface of the vertical arm of the bell crank lever and extends through the vertical arm passageway and screws into the central screw threaded opening of the knife blade that lines up with the vertical arm passageway. A pull pin holds the bell crank lever in place in the housing, and the pull pin fits through the second opening at the top end of the housing and simultaneously through the horizontal arm passageway.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing wherein similar reference characters denote similar elements throughout the several views:

FIG. 7, is a bottom view of the subassembly of

DETAILED DESCRIPTION OF THE PREFERRED EMBODIMENT

Figure 1:
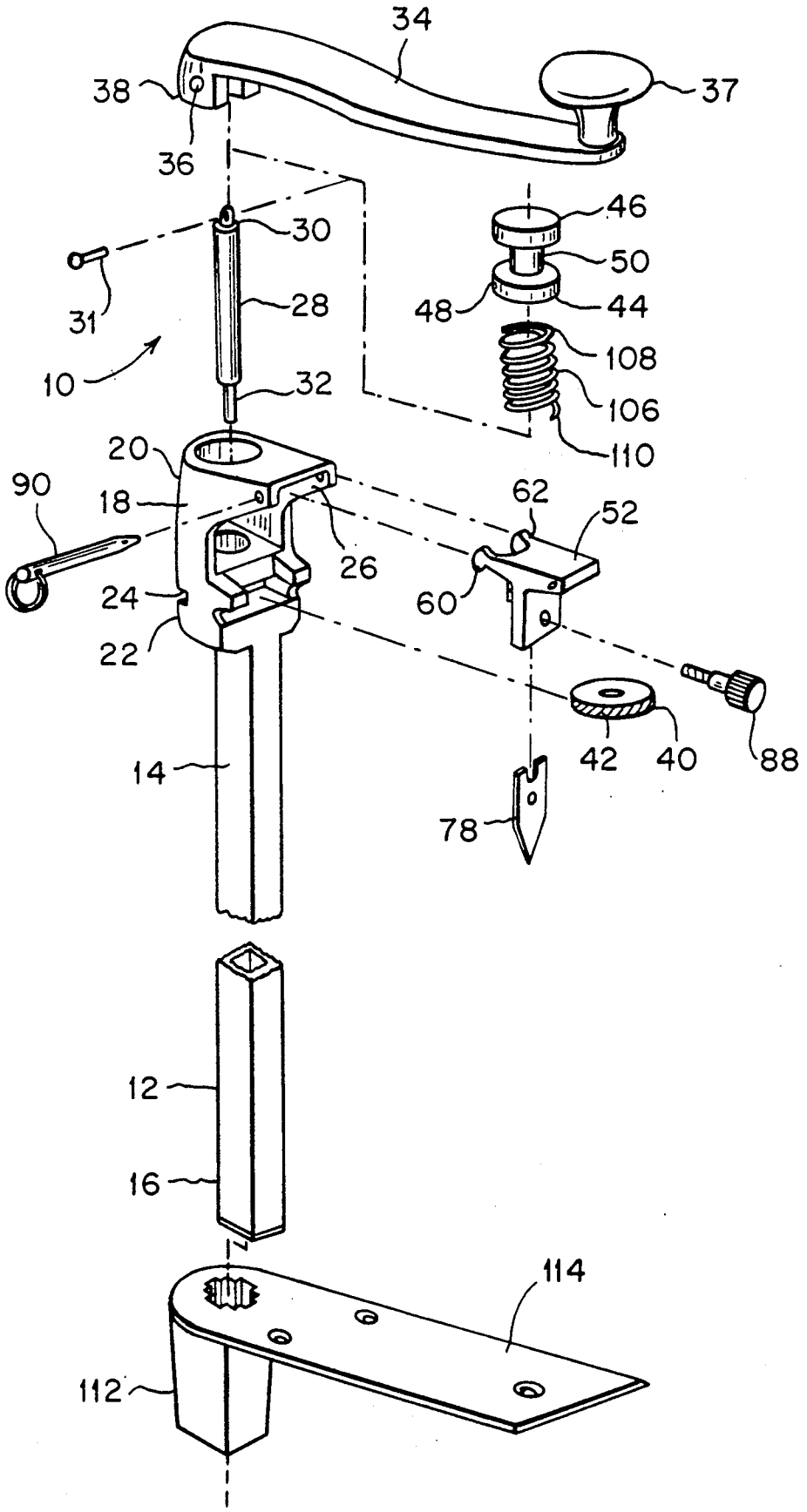
FIG. 1 is an exploded perspective view of the can opener device of the present invention.

Turning now, in detail, to the drawings, FIG. 1 shows a can opener device 10 which includes a vertically adjustable post 12, having a first end 14 and a second end 16. There is a housing 18 located at the first end 14 of the post 12, with the housing having a top end 20 and a bottom end 22. The housing has a first opening 24 at the bottom end and a second opening 26 at the top end. There is a vertical shaft 28, having a top end 30 and a bottom end 32 rotatably secured at the bottom end 32 of the shaft 28 within the housing 18 at the bottom end 22 of the housing.

A handle 34 is pivotally attached at a first end 36 to the top end 30 of the vertical shaft 28 by pin 31 for causing the rotational movement of the vertical shaft by rotation of the second end 37 of the handle. The handle has a cam 38 at the first end 36 of the handle 34 for causing vertical movement of the spool 44 downwardly when the handle is pivoted vertically upwardly. The cam of the handle causes the vertical movement of the spool 44 upwardly when the handle is pivoted vertically downwardly. The spool is pushed up by the spring when the handle is pivoted vertically downwardly.

A rotary gear or rotor 40 is within the housing and is secured into the vertical shaft 28 above the bottom end 32 of the vertical shaft 28. The rotor 40 protrudes through the first opening 24 at the bottom end of the housing, and the rotor 40 has gear teeth 42 on the periphery thereof for engaging and for rotating the can to be opened.

There is an I-shaped spool 44 on the vertical shaft 28 adjacent to the top end 30 of the vertical shaft 28 just below the handle 34. The I-shaped spool 44 includes an upper horizontal arm 46 and a lower horizontal arm 48 with a vertical arm 50 connecting the upper and the lower horizontal arms a spaced distance apart. The vertical shaft 28 passes through the hollow central portion of the spool 44.

Figure 8:
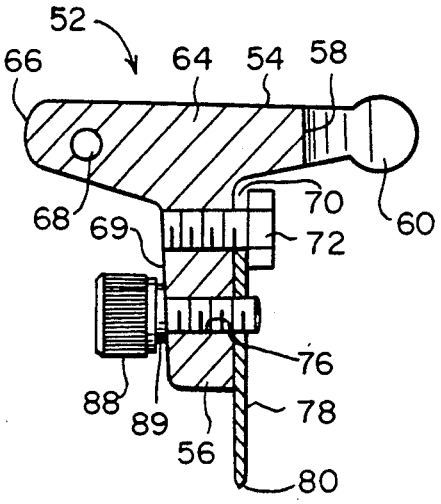
FIG. 8 is a section view of the subassembly along line 8—8 of FIG. 7.
Figure 6:
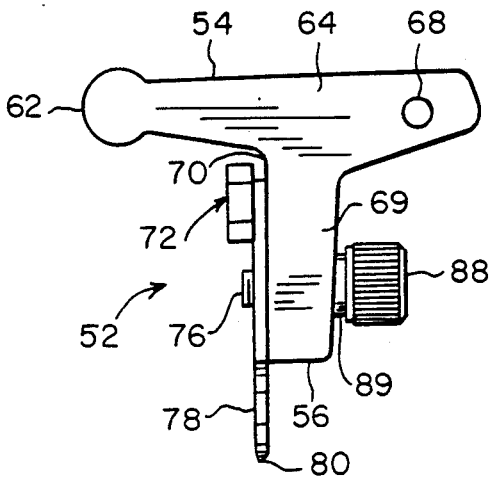
FIG. 6 is a side view of the subassembly of FIG. 5.
Figure 5:
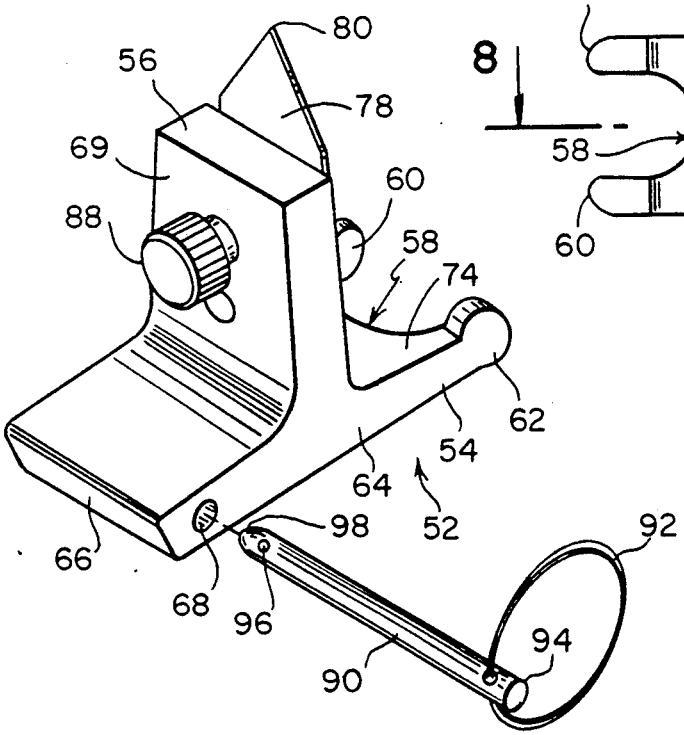
FIG. 5 is a perspective view of the knife cutting blade bell crank subassembly of the present invention.
Figure 7:
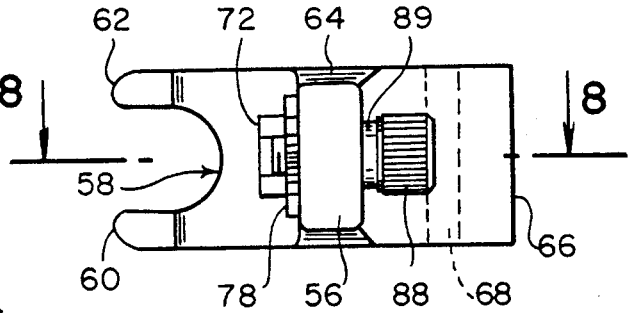

As shown in greater detail in FIGS. 5, 7 and 8, a T-shaped bell crank lever 52 of the subassembly has a horizontal arm 54 connected to a vertical arm 56. The horizontal arm 54 has a cut out reverse C-shaped end 58 (FIG. 3) comprising two spaced apart elbows 60 and 62. The horizontal arm 54 has a central portion 64 adjacent to the cut out end 58, with the vertical arm 56 attached to the horizontal arm 54 at the central portion 64. The horizontal arm 54 has a third portion 66 with a horizontal arm passageway 68 therethrough.

The spaced apart elbows 60 and 62 are positioned within the I-shaped spool 44 located between the upper and lower horizontal arms and around the vertical portion of the spool.

The vertical arm 56 of the bell crank lever 52 has an outside surface 69 and an inside surface 70. The inside surface 70 has a head shoulder screw or shoulder rivet 72 adjacent to the horizontal arm lower surface 74. A vertical arm passageway 76 connects the outside surface 69 to the inside surface 70 and is parallel to the rivet or screw 72.

A knife cutting blade 78 has a pointed end 80 for piercing and an angled edge 81 for cutting open the top of a ca to be opened. Knife blade 78 has an opposite end 82 with a cut out portion 84 that fits around the bushing 72 when the blade is adjacent to the inside, surface 70 of the vertical arm of the bell crank lever. The cutting blade has a central screw threaded opening 86 that lines up with the bell crank vertical arm passageway 76.

An adjustable fastener 88 which may include a plastic or rubber compressible spacer O-ring 89 is placed adjacent to the outside surface 69 of the vertical arm 56 of the bell crank lever 52. This fastener 88 extends through the vertical arm passageway 76. This adjustable fastener 88 screws into the central screw threaded opening 86 of the knife blade 78 that lines up with the vertical arm passageway 76. The knife blade is held in place on the vertical arm 56 by the combination of shoulder screw 72 and fastener 88. The O-ring 89 on fastener 88 acts as a spring to keep fastener 88 from loosening up during use and allows fastener 88 to adjust to the irregular surface of vertical arm 56. This O-ring 89 also allows fastener 88 to be tightened or loosened without the use of tools, so that knife blade 78 can be cleaned or replaced.

A pull pin 90 holds the bell crank lever 52 in place in the housing. The pull pin fits through the second opening at the top end of the housing and simultaneously fits through the horizontal arm passageway 68 of the bell crank lever.

The pull pin 90 has two ends, with a gripping means or ring 92 at one end 94 for the removal of the pin from the horizontal arm passageway 68. The pull pin further has a protruding button 96 at the other end 98 for preventing the pull pin from being unintentionally removed from the horizontal arm passageway 68.

The top end of the housing includes a top horizontal wall 100. The bottom end of the housing includes a bottom horizontal wall 102. The housing further includes a vertical housing wall 104 connecting the top horizontal wall 100 and the bottom horizontal wall 102 a spaced distance apart.

A spring 106 is located within the housing, and it fits around and surrounds the vertical shaft 28. The spring has a first end 108 and a second end 110. The first end 108 of the spring 106 is in contact with the lower horizontal arm 48 of the I-shaped spool. The second end 110 of the spring is in contact with the bottom horizontal wall 102 of the housing.

Figure 2:
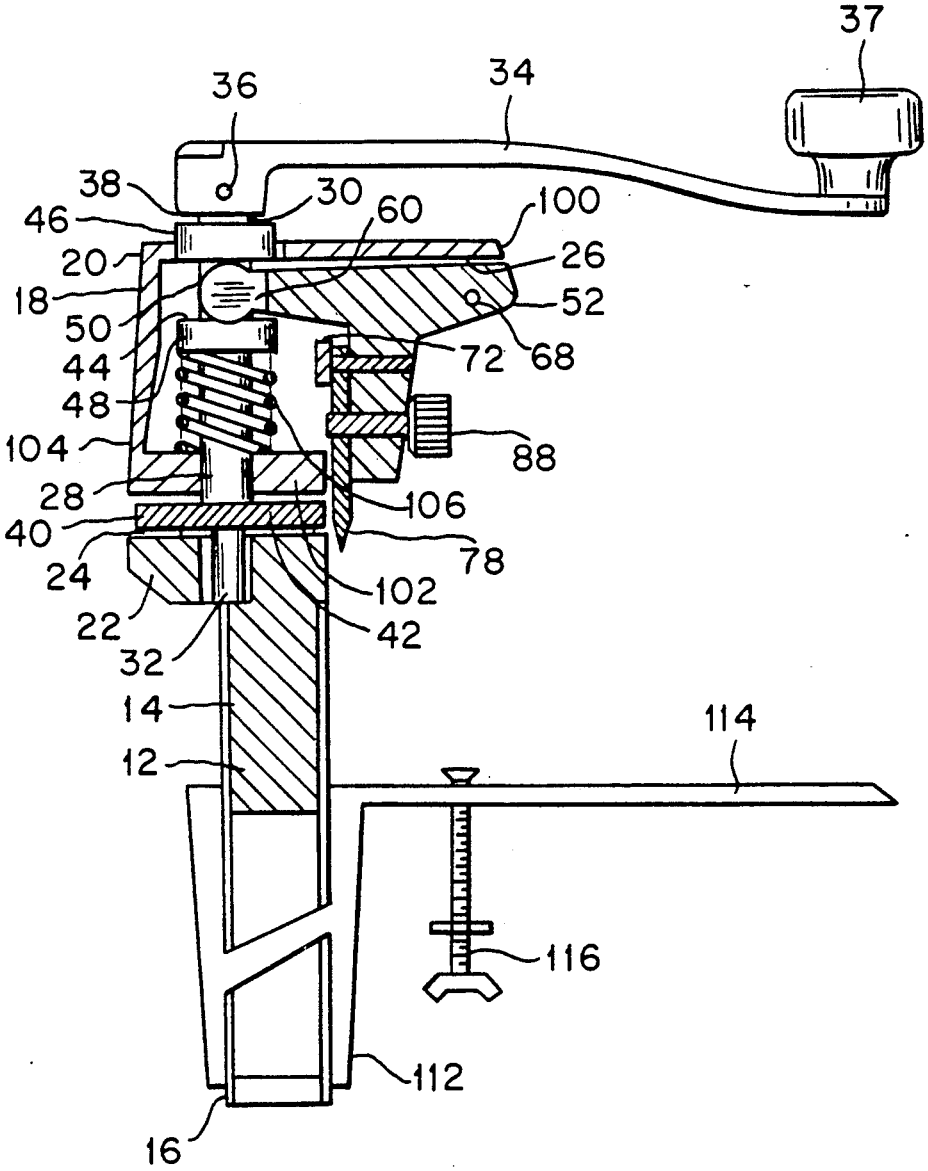
FIG. 2 is a side sectional view of the can opener of the present invention, with the handle horizontally down.
Figure 3:
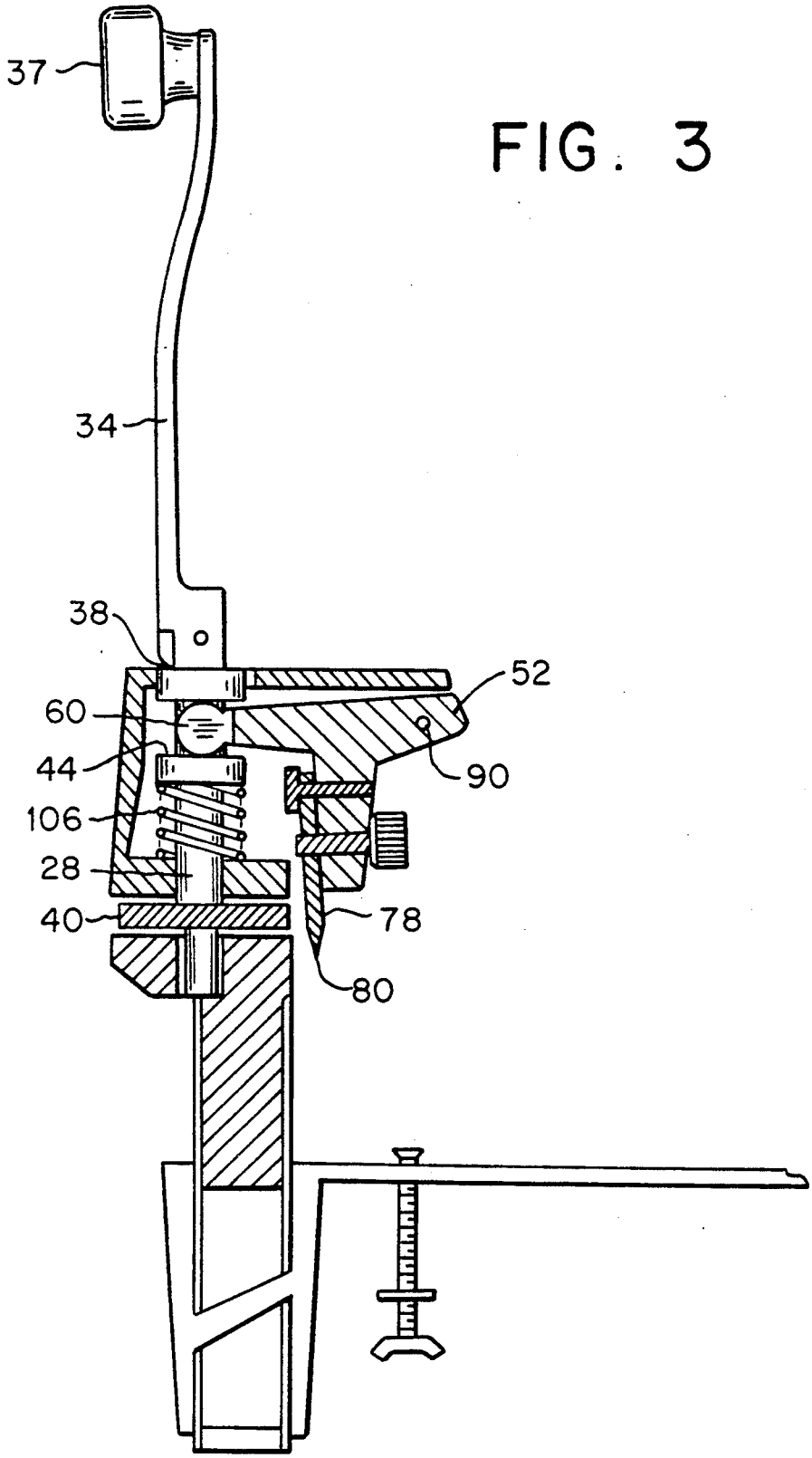
FIG. 3 is a side sectional view of the can opener with the handle vertically up.

Whenever the handle 34 is pivoted vertically upwardly as shown in FIG. 3, it causes the spool 44 to move downwardly to compress the spring 106 and to move downwardly the spaced apart elbows 60 and 62 within the I-shaped spool 44, causing the bell crank lever 52 to pivot around the pull pin 90, such that the knife blade 78 moves away from the rotor 40. Whenever the handle 34 is pivoted vertically downwardly, as shown in FIG. 2, it causes the spool 44 to move upwardly by expansion of the spring 106 and to move upwardly the spaced apart elbows 60 and 62 within the I-shaped spool 44, causing the bell crank lever 52 to pivot around the pull pin 90, such that the knife blade 78 moves toward the rotor 42.

Figure 4:
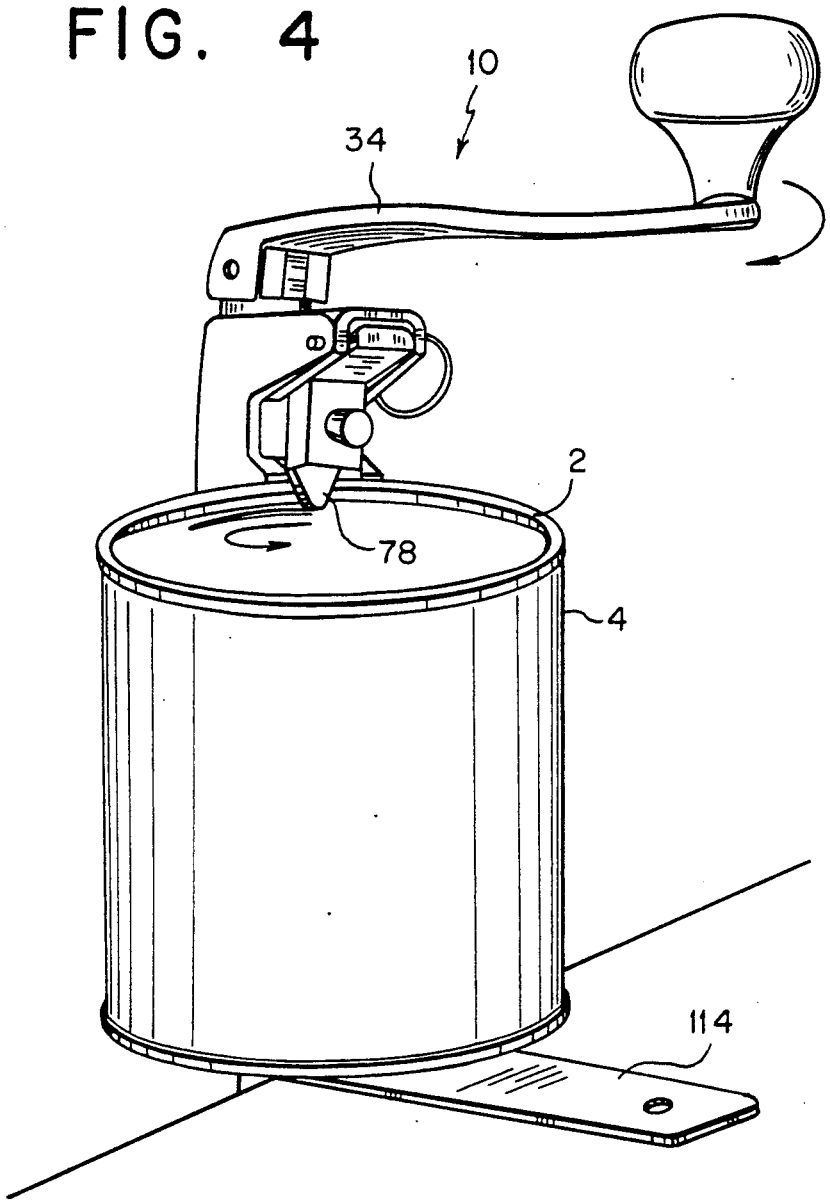
FIG. 4 is a perspective view showing the can opener in use opening a can.
Figure 9:
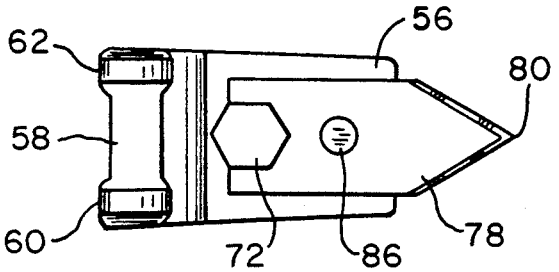
FIG. 9 is a side view of the subassembly of FIG. 5.
Figure 10:
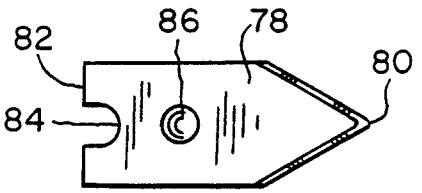
FIG. 10 is a top view of a knife cutting blade for use with the can opener device of the present invention.

FIG. 4 illustrates the actual utilization of the can opener device 10 in the opening of the top 2 of a can 4 by the rotary movement of handle 34. First the handle 34 is raised into the vertical position shown in FIG. 3 with the knife blade 78 moved a further distance away from the gear rotor 40. Then the can 4 is placed in position on the horizontal plate 114 beneath the cutting point 80 of the knife. The cutting point then penetrates the can top 2. Afterwards, the handle 34 is shifted to the horizontal position shown in FIG. 2, which causes the knife blade 78 to move into close proximity adjacent to the rotor 40 for cutting the can top 2 smoothly adjacent to the edge of the can 4.

There is a vertical sleeve 112, within which the second end 16 of the post 12 is vertically adjustable. A horizontal plate 114 extends laterally from the vertical sleeve. Means 116 attaches the horizontal plate 114 to a horizontal surface upon which the can is placeable prior to the opening thereof.

The opener can be completely disassembled by placing the opener into the base, raising the handle and removing the knifeholder by pulling out the pin. The handle assembly which contains the knob, handle and vertical shaft 28 can then be removed by holding the rotor 40 stationary and rotating the handle counter clockwise. The knife blade of hardened stainless steel can be removed from the bell crank knifeholder using a knurled screw. The base which is mounted to the table by bolts and wing nuts also can be removed for cleaning.

The can opening device, according to the present invention, has the advantages that the cutting blade bell crank subassembly, which comprises the bell crank lever 52 and the attached knife 78, can be readily removed from the device for ease of cleaning and for readily replacing a worn out knife blade or any other worn out part. The cutting blade bell crank subassembly is removed from the can opening device by removing the pull pin 90 from the horizontal portion passageway 68. This is readily accomplished by grasping the ring gripping means 92 and pulling it toward the person who is holding gripping means 92 with his finger and forcefully pulling out the pin, so that protruding button 96 is pulled through the horizontal passageway 68. After removing pin 90, the subassembly, including the bell crank lever 52, can be taken out of the can opening device. Then the adjustable fastener 88 is removable and is unscrewed to the extent that it no longer fits into the central screw threaded opening 86 that holds the knife in position adjacent to the vertical arm 56 of the bell crank lever. Then the knife blade is pulled away from the rivet 72, such that the cut out portion 84 no longer is fitted around the rivet 72. This makes it possible to clean the knife blade or to replace it, as well as to clean the bell crank lever 52 or any other component part within the ca opening device. The can opening device can readily be reassembled by reversing the steps discussed above.

While only a single embodiment of the present invention has been shown and described, it is to be understood that many changes and modifications may be made thereunto, without departing from the spirit and scope of the present invention a defined in the appended claims.

What is claimed is:

1. A cutting blade bell crank subassembly for use in a housing of a can opening device comprising:

a T-shaped bell crank lever having a horizontal arm connected to a vertical arm;

said horizontal arm having a cut out reverse C-shaped end comprising two spaced apart elbows, said horizontal arm having a central portion adjacent to said cut out end with said vertical arm attached to said horizontal arm at said central portion, said horizontal arm having a third portion with a horizontal arm passageway therethrough;

said vertical arm of said bell crank lever having an outside surface and in inside surface, said inside surface having a rivet adjacent to said horizontal arm lower surface;

a vertical arm passageway connecting said outside surface to said inside surface and parallel to said rivet;

a knife cutting blade having a pointed end for cutting open the top of a can to be opened, an opposite end with a cut out portion that fits around said rivet when said blade is adjacent to said inside surface of said vertical arm of said bell crank lever;

a central screw threaded opening in said knife blade that lines up with said bell crank vertical arm passageway;

an adjustable removable fastener is placed adjacent to the outside surface of said vertical arm of said bell crank lever and extends through said vertical arm passageway and screws into said central screw threaded opening of said knife blade that lines up with said vertical arm passageway; and a compressible spacer located between said adjustable fastener and said vertical arm of said bell crank lever and placed adjacent to said outside surface of the vertical arm.

2. The subassembly of claim 1, further comprising:

a pull pin for holding said bell crank lever in place in said housing, said pull pin fitting through an opening at the top end of said housing and simultaneously through said horizontal arm passageway.

3. The subassembly of claim 2, wherein said pull pin further comprises two ends with a gripping means at one end for the removal of the pin from the horizontal arm passageway; and a protruding button at the other end for preventing the pull pin from unintentional removal from the horizontal arm passageway.

4. A cutting blade bell crank subassembly for use in a housing of a can opening device comprising:

a T-shaped bell crank lever having a horizontal arm connected to a vertical arm;

said horizontal arm having a cut out reverse C-shaped end comprising two spaced apart elbows, said horizontal arm having a central portion adjacent to said cut out end with said vertical arm attached to said horizontal arm at said central portion, said horizontal arm having a third portion with a horizontal arm passageway therethrough;

said vertical arm of said bell crank lever having an outside surface and in inside surface, said inside surface having a rivet adjacent to said horizontal arm lower surface;

a vertical arm passageway connecting said outside surface to said inside surface and parallel to said rivet;

a knife cutting blade having a pointed end for cutting open the top of a can to be opened, an opposite end with a cut out portion that fits around said rivet when said blade is adjacent to said inside surface of said vertical arm of said bell crank lever;

a central screw threaded opening in said knife blade that lines up with said bell crank vertical arm passageway;

an adjustable removable fastener is placed adjacent to the outside surface of said vertical arm of said bell crank lever and extends through said vertical arm passageway and screws into said central screw threaded opening of said knife blade that lines up with said vertical arm passageway;

a pull pin for holding said bell crank lever in place in said housing, said pull pin fitting through an opening at the top end of said housing and simultaneously through said horizontal arm passageway;

a protruding button at the other end for preventing the pull pin from unintentional removal from the horizontal arm passageway.

5. A can opening device comprising:

a vertically adjustable post having a first end and a second end;

a housing located at the first end of said post, said housing having a top end and a bottom end, and said housing having a first opening at the bottom end and a second opening at the top end;

a vertical shaft having a top end and a bottom end rotatably secured at the bottom end of said shaft within said housing at the bottom end of said housing;

a spool surrounding said vertical shaft at the top end thereof;

a handle pivotally attached at a first end to said top end of said vertical shaft for causing the rotational movement of said vertical shaft by rotation of the second end of said handle, said handle having a cam at said first end of said handle for causing the vertical movement of said spool downwardly when said handle is pivoted vertically upwardly, and said cam of said handle causing the vertical movement of said spool upwardly when said handle is pivoted vertically downwardly;

a rotor within said housing and secured to said vertical shaft above the bottom end of said vertical shaft, said rotor protruding through the first opening a the bottom end f the housing and said rotor having teeth on the periphery thereof for engaging and for rotating the can to be opened;

said spool being an I-shaped spool on said vertical shaft adjacent to said top end of said vertical shaft just below said handle, said spool comprising an upper horizontal arm and a lower horizontal arm with a vertical arm connecting the upper and lower horizontal arm a spaced distance apart, said vertical shaft passing through the hollow central portion of said spool;

a T-shaped bell crank lever having a horizontal arm connected to a vertical arm;

said horizontal arm having a cut out reverse C-shaped end comprising two spaced apart elbows, said horizontal arm having a central portion adjacent to said cut out end with said vertical arm attached to said horizontal arm at said central portion, said horizontal arm having a third portion with a horizontal arm passageway therethrough;

said spaced apart elbows positioned within said I-shaped spool;

said vertical arm of said bell crank lever having an outside surface and an inside surface, said inside surface having a rivet adjacent to said horizontal arm lower surface;

a vertical arm passageway connecting said outside surface to said inside surface and parallel to said rivet;

a knife cutting blade having a pointed end for cutting open the top of a can to be opened, an opposite end with a cut out portion that fits around said rivet when said blade is adjacent to said inside surface of said vertical arm of said bell crank lever;

a central screw threaded opening in said knife blade that lines up with said bell crank vertical arm passageway;

an adjustable removable fastener is placed adjacent to the outside surface of said vertical arm of said bell crank lever and extends through said vertical arm passageway and screws into said central screw threaded opening of said knife blade that lines up with said vertical arm passageway;

a compressible spacer located between said adjustable fastener and said vertical arm of said bell crank lever and placed adjacent to said outside surface of the vertical arm; and a pull pin for holding said bell crank lever in place in said housing, said pull pin fitting through said second opening at the top end of said housing and simultaneously through said horizontal arm passageway.

6. The can opening device of claim 5, wherein said pull pin further comprises two ends with a gripping means at one end for the removal of the pin from the horizontal arm passageway; and a protruding button at the other end for preventing the pull pin from unintentional removal from the horizontal arm passageway.

7. The can opening device of claim 6, further comprising a spring within said housing and surrounding said vertical shaft;

said spring having a first end and a second end;

the first end of said spring in contact with the lower horizontal arm of said I-shaped spool; and the second end of said spring in contact with said bottom horizontal wall of said housing.

8. The can opening device of claim 5, wherein said top end of said housing comprises a top horizontal wall;

wherein said bottom end of said housing comprises a bottom horizontal wall; and said housing further comprising a vertical housing wall connecting the top and bottom horizontal wall a spaced distance apart.

9. The can opening device of claim 8, wherein said handle is pivoted vertically upwardly, causing said spool to move downwardly to compress said spring and to move downwardly said spaced apart elbows within said I-shaped spool, causing said bell crank lever to pivot around said pull pin such that said knife blade moves away from said rotor; and wherein said handle is pivoted vertically downwardly, causing said spool to move upwardly by expansion of said spring and to move upwardly said spaced apart elbows within said I-shaped spool, causing said bell crank lever to pivot around said pull pin such that said knife blade moves toward, said rotor.

10. The can opening device of claim 5, further comprising a vertical sleeve within which the second end of said post is vertically adjustable;

a horizontal plate extending laterally from said vertical sleeve; and means to attach said horizontal plate to a horizontal surface upon which said can is placeable prior to opening.

* * * * *